United States Patent [19]

Yamazoe

[11] Patent Number: 4,932,523

[45] Date of Patent: Jun. 12, 1990

[54] PROTECTIVE BOX-SHAPED TUBE FOR INSERTING A GOLF CLUB INTO A GOLF BAG

[75] Inventor: Wataru Yamazoe, No. 17-14, 4-chome, Todoroki, Setagaya-ku, Tokyo, Japan

[73] Assignees: Wataru Yamazoe, Tokyo; Takahiro Yamazoe, Toyohashi; Makiko Yamazoe; Yuriko Yamazoe, both of Tokyo, all of Japan

[21] Appl. No.: 376,309

[22] Filed: Jul. 6, 1989

[30] Foreign Application Priority Data

May 26, 1989 [JP] Japan ..... 64-161075[U]

[51] Int. Cl.[5] ..... A63B 55/00

[52] U.S. Cl. ..... 206/315.6; 206/315.2; 206/315.4

[58] Field of Search ..... 150/159, 160; 206/315.2–315.8; 211/70.2

[56] References Cited

U.S. PATENT DOCUMENTS

| | | | |
|---|---|---|---|
| 1,951,158 | 3/1934 | Locke et al. | 206/315.6 X |
| 2,325,474 | 7/1943 | Cart | 206/315.7 |
| 2,595,987 | 5/1952 | Shears | 206/315.6 |
| 2,607,382 | 8/1952 | Le Uine | 206/315.6 |
| 2,722,258 | 11/1955 | Smidt et al. | 206/315.6 |
| 2,879,819 | 3/1959 | Turnbull | 206/315.4 |
| 2,925,840 | 2/1960 | Hird | 206/315.4 |
| 3,053,298 | 9/1962 | Stamp | 206/315.2 |
| 3,554,255 | 1/1971 | Mangan | 206/315.6 |
| 4,497,404 | 2/1985 | Lowrance | 206/315.2 |
| 4,838,416 | 6/1989 | Carman | 206/315.2 |

FOREIGN PATENT DOCUMENTS

| | | | |
|---|---|---|---|
| 3132 | of 1912 | United Kingdom | 206/315.5 |
| 345825 | 4/1931 | United Kingdom | 206/315.3 |
| 476107 | 11/1937 | United Kingdom | 206/315.3 |
| 859116 | 1/1961 | United Kingdom | 206/315.7 |

*Primary Examiner*—Sue A. Weaver

*Attorney, Agent, or Firm*—Dilworth & Barrese

[57] ABSTRACT

The present invention discloses a protective box-shaped tube for inserting a putter into a golf bag and capable of fitting to a conventional golf bag in order to prevent damage of the face of a putter inserted into the golf bag.

The protective box-shaped tube for inserting a putter according to the present invention is provided with an opening for inserting a putter into the golf bag, latching arms mounted at bilateral sides opposite each other of the tube, a holding frame for holding the putter in a manner across two partition frames mounted at an opening portion of the golf bag by the latching arms, and a protective cover freely detachable fitted to both ends of the box-shaped tube of the holding frame.

13 Claims, 3 Drawing Sheets

PROTECTIVE BOX-SHAPED TUBE FOR INSERTING A GOLF CLUB INTO A GOLF BAG

BACKGROUND OF THE INVENTION

The present invention relates to a protective box-shaped tube for inserting a putter into a golf bag which can be fitted to the golf bag.

Hitherto, a conventional golf bag generally provides with three inlets or compartments (A) (B) (C) for bringing a golf club thereinto. The inlets or compartments are constituted by means of two partition frames (b) (c) mounted at an opening of the golf bag. Through the inlet or compartment (A), a wood club with a long shaft is inserted into the bag and an iron club with a comparatively long shaft is inserted into the bag through the inlet or compartment (B) and further an iron club with a short shaft is inserted into the bag through the inlet or compartment (C). A putter which is employed on the green in playing golf may be inserted into the bag through any of the aforementioned three inlets or compartments and there is no inlet or compartment exclusively for inserting the putter into the bag. Thus, the putter is inserted into the bag with the iron or wood club.

However, when the golf bag is carried or transported in a manner that the putter is inserted into the bag with the other clubs, there is a danger that the face of a putter is damaged. In other words, since the putter provides with a shorter shaft than those of the other golf clubs, when the putter is inserted into the bag through any of the three inlets or compartments (A) (B) (C) as it stands, the putter falls onto the bottom of said inlets or compartments, thereby damaging the face of a putter due to touching the shafts of the other clubs. For this reason, the putter may be inserted into the bag by suspending one end of the head thereof onto the aforementioned partition frame (b) or (c), or the head is suspended across the partition frames (b) (c).

According to the conventional way, however, it may be noted that golf clubs bump each other within the golf bag in carriage or transportation of the bag; and as a result the face of a putter is damaged due to the face of an iron club or the shaft thereof. The face of a putter and particularly a "sweet" spot for hitting a golf ball are very crucial for a golf player.

SUMMARY OF THE INVENTION

With the above in mind, it is an object of the present invention to provide a protective box-shaped tube for inserting a putter into a golf bag which can fitted to a conventional golf bag.

The aforementioned object can be attained by a protective box-shaped tube for inserting a putter into a golf bag comprising a box-shaped tube provided with an inlet for inserting a putter into the golf bag, latching arms each mounted at bilateral sides opposing each other of said tube, a holding frame for holding said box-shaped tube across two partition frames mounted at the opening of the golf bag by means of the latching arms and a protective cover freely detachably fitted to both ends of said tube.

As illustrated in FIG. 1, the protective box-shaped tube for inserting a putter into a golf bag according to the present invention is employed by fitting the same to portions in the vicinity of the fixed ends of two partition frames to the golf bag. The holding frame of a putter of the protective box-shaped tube is suspended by means of the latching arms placed over said two partition frames in a manner across said frames. When the putter is inserted into the bag through the inlet or compartment (4), the head of a putter can be be suspended by means of the holding frame (2) in a manner across said two partition frames (b) (c). In this manner, the head of a putter suspended by the protective frame (2) can be protected by means of the protective cover freely detachable fitted to the protective box-shaped tube (1). Thus, the putter can be retained without movement on the partition frames of the opening of the golf bag, thereby preventing damage of the face of a putter caused by bumping the other clubs, particularly in carriage or transportation of the golf bag in which the putter is inserted into the bag with the other golf clubs.

DESCRIPTION OF THE PREFERRED EMBODIMENTS

Hereinafter, embodiments according to the present invention will be described in detail with reference to the drawings.

Figure 1:
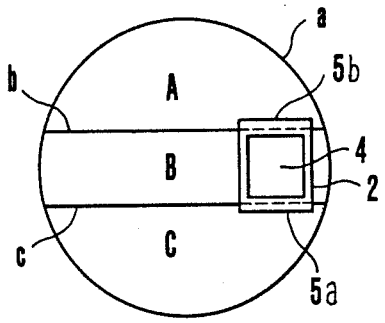
FIG. 1 is a schematic plan of a protective box-shaped tube for inserting a putter into a golf bag which can be fitted to a conventional golf bag according to the present invention.
Figure 2:
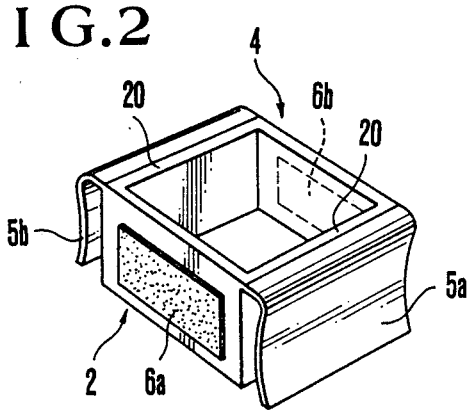
FIG. 2 is a perspective view of a holding frame of a putter according to the present invention.

A protective box-shaped (substantially quadrilaterally shaped) tube for inserting a putter into a golf bag (a) is constituted by a protective frame(2) for protecting the putter and a protective cover(3) of the putter. FIG. 2 shows one embodiment of the protective frame(2) according to the present invention and FIG. 3 shows the protective cover(3).

The protective frame(2) in the shape of a box illustrated in FIG. 2 is integrally made of synthetic resins by means of injection molding and is provided with an inlet or compartment (4) for inserted a putter into a golf bag and two latching arms (5*a*) (5*b*). The inlet or compartment (4) is constituted by an opening portion formed by a frame member (20) of the holding frame (2). The head of a putter is suspended on an upper end of said frame (2). The two latching arms (5*a*) (5*b*) are mounted at bilateral sides opposing each other of the holding frame (2) and engage with each partition frame (b) and (c) in a manner such the latching arms (5*a*) (5*b*) may hold said partition frames therebetween. Cotton or magic tapes (6*a*) (6*b*) are arranged at bilateral sides opposing each other of the holding frame (2) provided with no latching arms (5*a*) (5*b*).

Reference character denotes (a) a golf bag and A,B,C denote respective compartments constituted by means of the partition frames (b) (c).

Figure 3:
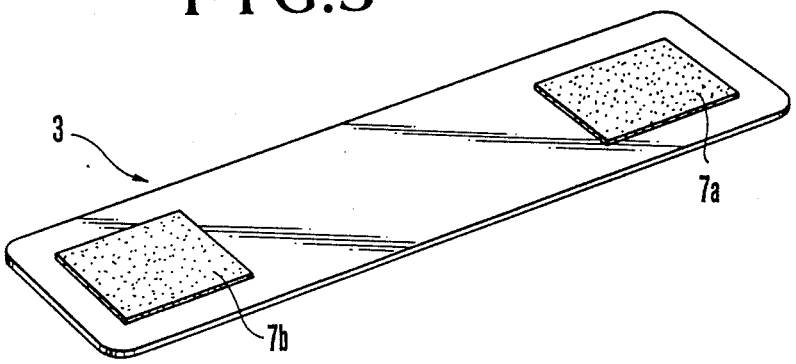
FIG. 3 is a back view of a protective cover according to the present invention.

The protective cover (3) illustrated in FIG. 3 is constituted in the shape of a band having almost the same width as that of the protective frame (2) of a putter. Further cotton or magic tapes (7*a*) (7*b*) are arranged at an inner surface of said protective cover (3) at both ends thereof. When middle a portion of said protective cover (3) in its longitudinal direction is widened, it becomes possible to cover the putter wholly in order to protect the same satisfactorily.

Figure 4:
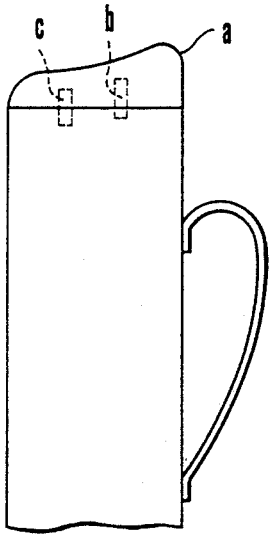
FIG. 4 is a partially schematic view of a golf bag.

The partition frames (b) (c) of a golf bag as illustrated in FIG. 4 are generally fitted to the golf bag with a step. In FIG. 4, the left partition frame (c) is positioned lower than the right partition frame (b).

Figure 5:
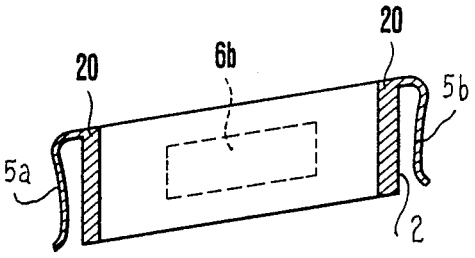
FIG. 5 is a sectional view of the holding frame of a putter according to the present invention.

Removal and insertion of golf clubs are usually undertaken from the partition frame (c) which is positioned lower. For this reason, it is preferable that the protective frame (2) as illustrated in FIG. 5 is constituted to have a latching arm (5*b*) engageable with the partition frame (b) at a higher position than the other latching arm (5*a*) (the left side in the Figure) which is engageable with the partition frame (c). Furthermore, the protective frame (2) can be fitted to the partition frames (b) (c) in conformity with the difference of the height of fitting positions of said partition frames (b) (c). In other words, the protective "box-shaped" tube provided with the holding frame (2) is inclined towards either of the sides provided with the latching arms (5*a*, 5*b*).

Figure 6:
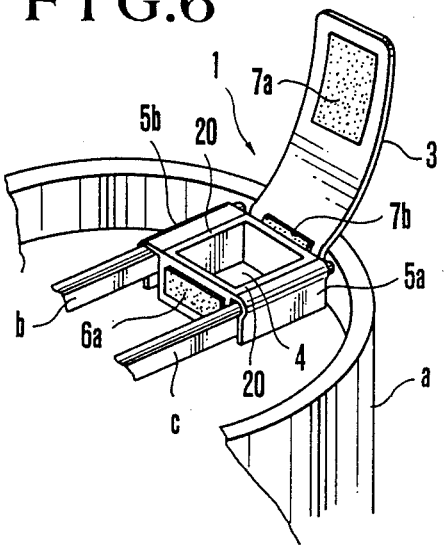
FIG. 6 and FIG. 7 show the embodiments of use of the protective box-shaped tube for inserting a putter into a golf bag according to the present invention.
Figure 7:
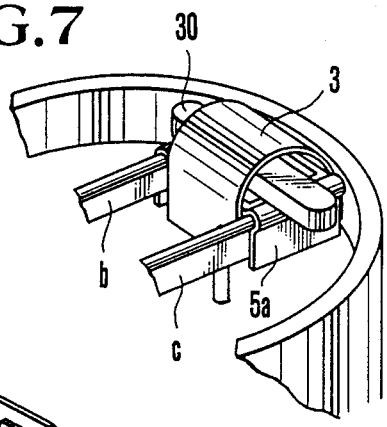

FIG. 6 shows the embodiment of fitting the protective box-shaped tube (1) according to the present invention to the partition frames (b) (c) mounted at the opening of the bag. Said protective frame (2) is freely detachably fitted to said two partition frames therebetween. The fitting positions to said partition frames are preferably positions in the vicinity of either of the right and left fixed positions of the partition frames. The cotton or magic tape (7*b*) at one end of the protective cover (3) is fitted to the cotton or magic tape (6*b*) of the protective frame (2). FIG. 7 shows the embodiment wherein the putter is inserted into the bag through the inlet or compartment (4) and the head (30) of a putter is covered with the protective cover (3), thereby preventing damage to said head of a putter.

Figure 8:
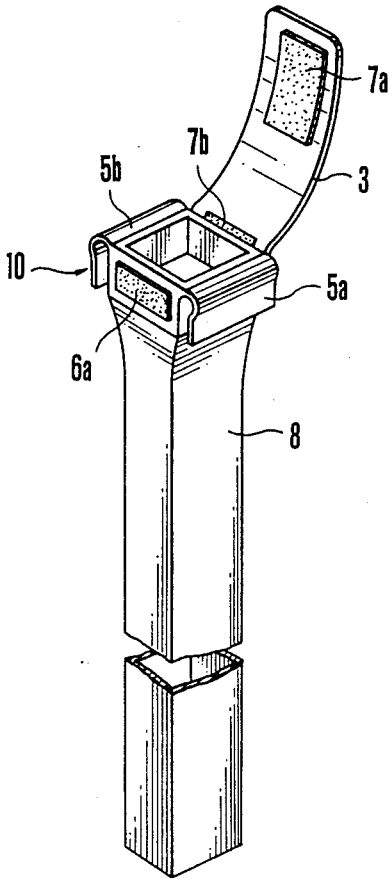
FIG. 8 is another embodiment of said protective box-shaped tube according to the present invention.

FIG. 8 shows another embodiment of the protective box-shaped tube (10) in the shape of a bag according to the present invention, wherein a shaft cover (8) for protecting the shaft of a putter is fitted to said protective box-shaped tube (10).

Said shaft cover is made of synthetic plastics in the shape of a bag and has the length to bring the shaft of a putter thereinto. Further, said shaft cover is integrally constituted to couple with a lower end of said protective box-shaped tube (10). The shaft cover may also be made of such material as cloth or leather and may be firmly fixed to said protective tube (10) by adhesion or other coupling means.

Use of the protective box-shaped tube (10) in the shape of a bag provided with the cover shaft is, the same as that of the protective box-shaped tube (1). The shaft portion brought into the protective box-shaped tube (10) in the shape of a bag through the inlet or compartment (4) can be prevented from oscillating within the bag by means of the shaft cover so that the putter may be retained safely and stably.

As described above, according to the present invention, the inlet portion for inserting a putter into a golf bag can be constituted without any particular processing at the opening of the golf bag accordingly the putter can be inserted into the bag separate from iron clubs. Since the face of a putter can be covered with the protective cover, said face can be prevented from damage caused by bumping with adjacent iron clubs in carriage or transportation of the golf bag.

What is claimed is:

1. A protective, substantially-quadrilaterally shaped tube for inserting of a golf club into a golf bag therethrough, comprising, in combination, a holding frame (2) for a golf club and a protective cover (3) for the golf club, said cover (3) being substantially in the shape of a band, said holding frame (2) shaped to define an inlet or compartment (4) for inserting a golf club therethrough and additionally comprising two latching arms (5*a*, 5*b*) engageable with two respective partition frames (b, c) of a golf bag (a), said latching arms (5*a*, 5*b*) being mounted at opposite bilateral sides (20, 20) of said holding frame (2), and means for mounting said cover (3) upon said holding frame (2), said means being positioned on bilateral sides of said holding frame (2) not provided with said latching arms (5*a*, 5*b*) and on a surface of said cover (3).

2. The tube of claim 1, wherein said mounting means are constituted by adhesion tapes mounted upon said respective bilateral sides of said holding frame (2) and upon said cover (3), said tapes being formed and positioned to mate with one another to mount said cover upon said frame.

3. The tube of claim 2, wherein said respective adhesion tape is mounted upon an internal surface of said protective cover at both ends thereof.

4. The tube of claim 12, wherein one of the partition frames (b) is higher than the other partition frame (c), and said holding frame (2) is inclined such that one of said latching arms (5*b*) is at a higher position than said other latching arm (5*a*), whereby said respective higher and lower latching arms (5*b*, 5*a*) can engage the respective upper and lower partition frames (b, c) of the golf bag (a).

5. The tube of claim 1, wherein said protective, box-shaped tube provided with said holding frame (2) is inclined towards either of said bilateral sides provided with said latching arms (5*a*, 5*b*).

6. The tube of claim 1, additionally comprising a shaft cover (8) integrally fixed to a lower end of said holding frame (2).

7. The tube of claim 5, additionally comprising a shaft cover (8) integrally fixed to a lower end of said holding frame (2).

8. The tube of claim 1, wherein said holding frame (2) is arranged to be freely detachably retained on both the partition frames (b, c) through said respective latching arms (5*a*, 5*b*).

9. The tube of claim 8, wherein each said latching arms are mounted upon said holding frame (2) to retain the respective partition frame (b, c) between said respective latching arm (5*a*, 5*b*) and said holding frame (2).

10. The tube of claim 8, wherein said cover is arranged to be freely detachably mounted upon said frame through said mounting means.

11. The tube of claim 1 wherein said holding frame (2) and latching member (5*a*, 5*b*) are mountable upon the partition frames (b, c) and the holding frame is dimensioned such that the golf club, when inserted into said inlet or compartment (4), is suspended by said holding frame (2) across the two partition frames (b, c).

12. The tube of claim 1, wherein width of said substantially band-shaped cover is substantially the same as width of said holding frame (2).

13. The tube of claim 8, additionally comprising a shaft cover (8) integrally fixed to a lower end of said holding frame (2).

* * * * *